US005932033A

United States Patent [19]

Jackson et al.

[11] Patent Number: 5,932,033

[45] **Date of Patent: *Aug. 3, 1999**

[54] SILICIDE COMPOSITE WITH NIOBIUM-BASED METALLIC PHASE AND SILICON-MODIFIED LAVES-TYPE PHASE

[75] Inventors: Melvin Robert Jackson; Bernard Patrick Bewlay, both of Niskayuna, N.Y.

[73] Assignee: General Electric Company, Schenectady, N.Y.

[ * ] Notice: This patent is subject to a terminal disclaimer.

[21] Appl. No.: 09/133,365

[22] Filed: Aug. 12, 1998

[51] Int. Cl.[6] ..... C22C 27/02

[52] U.S. Cl. ..... 148/422; 148/442; 420/426; 420/588

[58] Field of Search ..... 148/422, 442; 420/425, 426, 578, 588

[56] References Cited

U.S. PATENT DOCUMENTS

| | | | |
|---|---|---|---|
| 4,762,557 | 8/1988 | Nagarajan et al. | 75/244 |
| 4,915,903 | 4/1990 | Brupbacher et al. | 420/129 |
| 5,640,666 | 6/1997 | Jayashanker et al. | 419/17 |
| 5,721,061 | 2/1998 | Jackson et al. | 428/641 |
| 5,741,376 | 4/1998 | Subramanian et al. | 148/422 |

OTHER PUBLICATIONS

Copending U.S. application No. 08/498,826, filed Jul. 6, 1995, entitled "Nb–Base Alloys", Bewlay et al.

*Primary Examiner*—John Sheehan
*Attorney, Agent, or Firm*—Ernest G. Cusick; Noreen C. Johnson

[57] ABSTRACT

A silicide-based composite toughened with a niobium-based metallic phase, and further containing a phase that significantly improves the oxidation resistance of the composite. The oxidation-resistant phase is a chromium-based Laves-type phase modified with silicon, which has been shown to greatly increase the oxidation resistance of silicide-based composites at temperatures of up to 1200 C. The oxidation-resistant silicide-based composite generally contains one or more silicide intermetallic phases, each of which is an $M_5Si_3$-type phase where M is Nb+Ti+Hf. The niobium-based metallic phase contains niobium, titanium, hafnium, chromium, aluminum and silicon. The silicon-modified Laves-type phase is of the $Cr_2M$ type where M is Nb+Ti+Hf. A silicide-based composite contains, in atomic percent, about 12–25% titanium, about 6–12% hafnium, about 15–25% chromium, about 1–8% aluminum and about 12–20% silicon, with the balance essentially niobium.

19 Claims, 1 Drawing Sheet

SILICIDE COMPOSITE WITH NIOBIUM-BASED METALLIC PHASE AND SILICON-MODIFIED LAVES-TYPE PHASE

FIELD OF THE INVENTION

The present invention relates to silicide-based composites toughened with a metallic phase. More particularly, this invention relates to a silicide-based composite toughened with a niobium-based metallic phase and containing a silicon-modified Laves-type phase that improves the oxidation resistance of the composite at elevated temperatures.

BACKGROUND OF THE INVENTION

Various high temperature materials have been developed for use in gas turbine engines. Cobalt-base and nickel-base superalloys have found wide use in the manufacture of gas turbine engine components such as nozzles, combustors, and turbine vanes and blades. Other materials, including niobium-based alloys, have been considered for the high temperature regions of gas turbine engines, such as the turbine and exhaust sections. For example, on the basis of promising acceptable levels of fracture toughness and creep resistance, silicide-based composites toughened with a niobium-based metallic phase (e.g., NbTiHfCrAlSi solid solution) have been investigated for applications where blade surface temperatures may exceed 1200 C. However, niobium and niobium-containing compositions generally do not exhibit a sufficient level of oxidation resistance at elevated temperatures. For this reason, niobium-containing materials intended for high temperature applications have typically required an oxidation-resistant coating, particularly if operating temperatures will exceed about 800 C. Commercially-available fusion coatings based on, in weight percent, Si-20Fe-20Cr have been proven effective in improving the oxidation resistance of niobium-base alloys. However, the high-temperature fusion (reaction bonding) process can be detrimental to the material, depending on its nature. In addition, the Si-20Fe-20Cr alloy has not proven to be suitable as an oxidation-resistant coating for silicide composites with a niobium-based reinforcement phase.

Therefore, it would be desirable if a silicide-based composite were available that exhibited improved oxidation resistance at temperatures of up to 1200 C., to enable such a material to be used in the hot section (turbine and exhaust) of a gas turbine engine without an oxidation-resistant coating.

SUMMARY OF THE INVENTION

According to the present invention, there is provided a silicide-based composite toughened with a niobium-based metallic phase, and further containing a phase that significantly promotes the oxidation resistance of the composite. The oxidation-resistant phase is a chromium-based Laves-type phase modified with silicon. More particularly, the Laves-type phase is of the $Cr_2M$ type where, in the niobium-containing silicide composite of this invention, M is at least Nb. The silicon-modified chromium-based Laves-type phase has been shown to greatly increase the oxidation resistance of a NbTiHfCrAlSi composite at temperatures of up to 1200 C.

Oxidation-resistant silicide-based composites in accordance with this invention generally contain one or more $M_5Si_3$-type silicide intermetallic phases. The niobium-based metallic phase will generally contain each of the elements present in the composite. Accordingly, in a NbTiHfCrAlSi composite, the niobium-based metallic phase contains niobium, titanium, hafnium, chromium, aluminum and silicon, each silicide intermetallic phase is an $M_5Si_3$-type phase where M is Nb+Ti+Hf, and the silicon-modified Laves-type phase is of the $Cr_2M$ type where M is Nb+Ti+Hf+Si. A silicide-based composite that typifies the invention has a nominal composition, in atomic percent, of about 35% niobium, about 18% titanium, about 7% hafnium, about 20% chromium, about 2% aluminum and about 18% silicon, and contains about 42 volume percent of the silicide intermetallic, about 25 volume percent of the niobium-based metallic phase, and about 33 volume percent of the silicon-modified Laves-type phase.

According to the invention, the silicon-modified chromium-based Laves-type phase has been shown to impart considerable oxidation resistance to a silicide-based composite toughened with a niobium-based metallic phase when subjected to oxidizing conditions similar to that present in the hot section of a gas turbine engine. It is therefore anticipated that such Laves-type phases can be beneficial to a variety of silicide-based composites that contain a niobium-based metallic phase, and particularly composites containing niobium, titanium, hafnium, chromium, aluminum and silicon.

Other advantages of this invention will be better appreciated from the following detailed description.

DETAILED DESCRIPTION OF THE INVENTION

Figure 1:
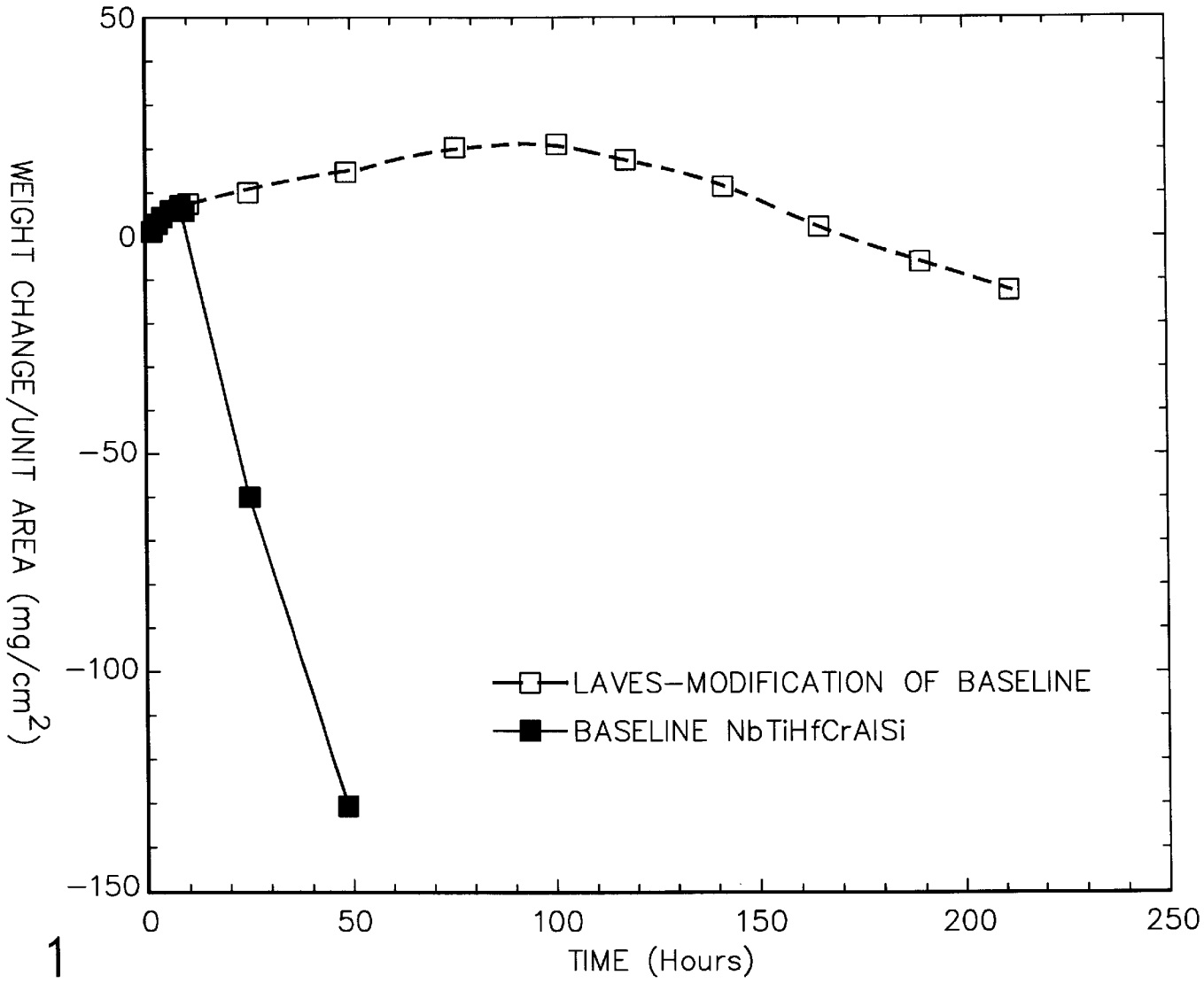
FIG. 1 is a graph representing data that show a dramatic improvement in oxidation resistance of a silicide-based composite that is toughened with a niobium-based metallic phase and incorporating the silicon-modified Laves-type phase of this invention, as compared to a similar composite without a silicon-modified Laves-type phase.

The present invention provides an oxidation-resistant silicide composite toughened with a niobium-containing metallic phase. The composite exhibits sufficient oxidation resistance at elevated temperatures of up to 1200 C., to be a candidate material for hot section components of a gas turbine engine. It is foreseeable that the composite of this invention could also be used to form other gas turbine engine components, including high and low pressure turbine nozzles and blades, shrouds, combustor liners and augmentor hardware. It is also within the scope of this invention that the composite could be used in numerous other applications in which a component is subjected to elevated temperatures.

The silicide composite of this invention generally contains at least one silicide intermetallic phase, a niobium-based metallic toughening phase, and a silicon-modified Laves phase of the $Cr_2M$-type. As used herein, the terms "Laves-type" and "Cr2M-type" designate a phase that resembles a $Cr_2M$ Laves phase, though the constituents of the phase are not necessarily present in the phase in stoichiometric amounts. In an embodiment where the composite is NbTiHfCrAlSi, M is Nb+Ti+Hf based. The presence of the Laves-type phase is the result of the composite containing significantly greater levels of chromium than that used to generate existing NbTiHfCrAlSi composites. Oxidation-resistant $Cr_2M$ Laves phases where M is primarily Nb+Ti+Hf have been identified in the past. With this invention, a silicon-modified $Cr_2M$ Laves-type phase has been achieved whose presence in a niobium-containing silicide-based composite has been shown to dramatically improve the oxidation resistance of such composites.

Suitable constituent ranges for the composite are, in atomic percent, about 12–25% titanium, about 6–12% hafnium, about 15–25% chromium, about 1–8% aluminum and about 12–20% silicon, with the balance essentially niobium. In the investigation leading to this invention, a silicide-based composite was formulated to have a nominal composition, in atomic percent, of about 35% niobium, about 18% titanium, about 7% hafnium, about 20% chromium, about 2% aluminum and about 18% silicon. This composition differed from earlier NbTiHfCrAlSi composites by reason of its considerably higher chromium content (20% as compared to a more typical 2% content). The composite was produced by arc melting and casting in a water-cooled copper mold.

Phase identifications were conducted by electron microprobe quantitative chemical analysis, which showed the composite to contain three silicide intermetallic phases of the $M_5Si_3$-type where M is Nb+Ti+Hf, a niobium-based metallic phase, and the desired silicon-modified $Cr_2M$ Laves-type phase. One of the silicide intermetallic phases had a nominal composition, in atomic percent, of about 41.5% niobium, about 12% titanium, about 8.5% hafnium, about 1% chromium, about 2.5% aluminum and about 34.5% silicon, a second of the silicide intermetallic phases had a nominal composition, in atomic percent, of about 30.5% niobium, about 18.5% titanium, about 13.5% hafnium, about 1% chromium, about 2.5% aluminum and about 34% silicon, while the third silicide intermetallic phase had a nominal composition, in atomic percent, of about 22% niobium, about 27% titanium, about 13.5% hafnium, about 1% chromium, about 2.5% aluminum and about 34% silicon.

The niobium-based metallic phase was analyzed as having a nominal composition, in atomic percent, of about 57% niobium, about 27% titanium, about 2.5% hafnium, about 10% chromium, about 2.5% aluminum and about 1% silicon. The silicon-modified Laves-type phase had a nominal composition, in atomic percent, of about 21% niobium, about 11% titanium, about 7% hafnium, about 51% chromium, about 2.5% aluminum and about 7.5% silicon. The silicide-based composite contained about 42 volume percent of the silicide intermetallic, about 25 volume percent of the niobium-based metallic phase, and about 33 volume percent of the silicon-modified Laves-type phase.

Pins approximately 0.26 inch (about 6.6 mm) in diameter with a length of about 0.565 inch (about 14.4 mm) were machined from the arc cast ingot by electrical discharge machining. Similarly sized pins were formed by essentially the same processes from a silicide-based composite having a nominal composition, in atomic percent, of about 46% niobium, about 26% titanium, about 8% hafnium, about 2% chromium, about 2% aluminum and about 16% silicon. Therefore, the second group of pins had a much lower chromium content than the pins formulated in accordance with this invention, and did not contain any significant amount of chromium-based Laves phase. The pins were then exposed isothermally at about 1200 C., with periodic removal from the furnace for observation and measurement of weight change as a result of oxidation.

The results of this test are portrayed in FIG. 1, which evidences that the oxidation resistance for the pins whose composite composition contained the silicon-modified Laves-type phase of this invention was dramatically superior to the pins with the lower chromium content. The data reveal a gradual weight gain (attributable to oxidation) of about 20 milligrams per square centimeter of surface for the pins of this invention, followed by a gradual weight loss. At two-hundred hours, these pins had lost about 10 $mg/cm^2$. In contrast, the pins formed of the low-chromium material exhibited an initial weight gain of about 10 $mg/cm^2$, followed by rapid weight loss of about 130 $mg/cm^2$ after only fifty test hours.

On the basis of this test, it was concluded that the presence of a silicon-modified chromium-based Laves-type phase has a significant effect on the oxidation resistance of a silicide-based composite toughened with a niobium-based metallic phase. While a silicide-based composite having a specific composition was employed to evaluate this invention, the benefits of a silicon-modified chromium-based Laves-type phase are believed to be generally applicable to all silicide-based composites toughened by a niobium-based metallic phase. Therefore, the scope of the invention is to be limited only by the following claims.

What is claimed is:

1. An oxidation-resistant silicide-based composite containing a silicide intermetallic phase, a niobium-based metallic phase and a silicon-modified chromium-based $Cr_2M$ Laves phase where M is at least Nb, wherein the silicide-based composite contains, in atomic percent, about 12–25% titanium, about 6–12% hafnium, about 15–25% chromium, about 1–8% aluminum and about 12–20% silicon, with the balance essentially niobium.

2. A silicide-based composite as recited in claim 1, wherein the silicide-based composite contains niobium, titanium, hafnium, chromium, aluminum and silicon.

3. A silicide-based composite as recited in claim 1, wherein the silicon-modified Laves phase is $Cr_2M$ where M is Nb+Ti+Hf.

4. A silicide-based composite as recited in claim 1, wherein multiple silicide intermetallic phases are present, and each of the silicide intermetallic phases is an $M_5Si_3$ phase where M is Nb+Ti+Hf.

5. A silicide-based composite as recited in claim 4, wherein one of the silicide intermetallic phases has a nominal composition, in atomic percent, of about 41.5% niobium, about 12% titanium, about 8.5% hafnium, about 1% chromium, about 2.5% aluminum and about 34.5% silicon.

6. A silicide-based composite as recited in claim 4, wherein one of the silicide intermetallic phases has a nominal composition, in atomic percent, of about 30.5% niobium, about 18.5% titanium, about 13.5% hafnium, about 1% chromium, about 2.5% aluminum and about 34% silicon.

7. A silicide-based composite as recited in claim 4, wherein one of the suicide intermetallic phases has a nominal composition, in atomic percent, of about 22% niobium, about 27% titanium, about 13.5% hafnium, about 1% chromium, about 2.5% aluminum and about 34% silicon.

8. A silicide-based composite as recited in claim 1, wherein the niobium-based metallic phase has a nominal composition, in atomic percent, of about 57% niobium, about 27% titanium, about 2.5% hafnium, about 10% chromium, about 2.5% aluminum and about 1% silicon.

9. A silicide-based composite as recited in claim 1, wherein the silicon-modified Laves phase has a nominal composition, in atomic percent, of about 21% niobium, about 11% titanium, about 7% hafnium, about 51% chromium, about 2.5% aluminum and about 7.5% silicon.

10. A silicide-based composite as recited in claim 1, wherein the silicide intermetallic constitutes about 42 volume percent of the silicide-based composite, the niobium-based metallic phase constitutes about 25 volume percent of the silicide-based composite, and the silicon-modified Laves phase constitutes about 33 volume percent of the silicide-based composite.

11. An oxidation-resistant silicide-based composite containing a silicide intermetallic, a niobium-based metallic phase and a silicon-modified Laves phase, the silicide-based composite containing, in atomic percent, about 12–25% titanium, about 6–12% hafnium, about 15–25% chromium, about 1–8% aluminum and about 12–20% silicon, with the balance essentially niobium.

12. A silicide-based composite as recited in claim 11, wherein the silicide intermetallic is an $M_5Si_3$ phase where M is Nb+Ti+Hf.

13. A silicide-based composite as recited in claim 11, wherein the silicide-based composite contains a plurality of different silicide intermetallics.

14. A silicide-based composite as recited in claim 13, wherein each of the silicide intermetallics is an $M_5Si_3$ phase where M is Nb+Ti+Hf, a first silicide intermetallic having a nominal composition, in atomic percent, of about 41.5% niobium, about 12% titanium, about 8.5% hafnium, about 1% chromium, about 2.5% aluminum and about 34.5% silicon, a second suicide intermetallic having a nominal composition, in atomic percent, of about 30.5% niobium, about 18.5% titanium, about 13.5% hafnium, about 1% chromium, about 2.5% aluminum and about 34% silicon, and a third silicide intermetallic having a nominal composition, in atomic percent, of about 22% niobium, about 27% titanium, about 13.5% hafnium, about 1% chromium, about 2.5% aluminum and about 34% silicon.

15. A silicide-based composite as recited in claim 11, wherein the niobium-based metallic phase has a nominal composition, in atomic percent, of about 57% niobium, about 27% titanium, about 2.5% hafnium, about 10% chromium, about 2.5% aluminum and about 1% silicon.

16. A silicide-based composite as recited in claim 11, wherein the silicon-modified Laves phase is $Cr_2M$ where M is Nb+Ti+Hf.

17. A silicide-based composite as recited in claims 16, wherein the silicon-modified Laves phase has a nominal composition, in atomic percent, of about 21% niobium, about 11% titanium, about 7% hafnium, about 51% chromium, about 2.5% aluminum and about 7.5% silicon.

18. A silicide-based composite as recited in claim 11, wherein the silicide intermetallic constitutes about 42 volume percent of the silicide-based composite, the niobium-based metallic phase constitutes about 25 volume percent of the silicide-based composite, and the silicon-modified Laves phase constitutes about 33 volume percent of the silicide-based composite.

19. An oxidation-resistant silicide-based composite containing silicide intermetallic phases, a niobium-based metallic phase and a silicon-modified Laves phase, wherein:

the silicide-based composite has a nominal composition, in atomic percent, of about 35% niobium, about 18% titanium, about 7% hafnium, about 20% chromium, about 2% aluminum and about 18% silicon;

each of the silicide intermetallic phases is an $M_5Si_3$ phase where M is Nb+Ti+Hf, a first silicide intermetallic phase having a nominal composition, in atomic percent, of about 41.5% niobium, about 12% titanium, about 8.5% hafnium, about 1% chromium, about 2.5% aluminum and about 34.5% silicon, a second silicide intermetallic phase having a nominal composition, in atomic percent, of about 30.5% niobium, about 18.5% titanium, about 13.5% hafnium, about 1% chromium, about 2.5% aluminum and about 34% silicon, and a third silicide intermetallic phase having a nominal composition, in atomic percent, of about 22% niobium, about 27% titanium, about 13.5% hafnium, about 1% chromium, about 2.5% aluminum and about 34% silicon;

the niobium-based metallic phase has a nominal composition, in atomic percent, of about 57% niobium, about 27% titanium, about 2.5% hafnium, about 10% chromium, about 2.5% aluminum and about 1% silicon;

the silicon-modified Laves phase is $Cr_2M$ where M is Nb+Ti+Hf, the silicon-modified Laves phase having a nominal composition, in atomic percent, of about 21% niobium, about 11% titanium, about 7% hafnium, about 51% chromium, about 2.5% aluminum and about 7.5% silicon; and the silicide intermetallic phases constitute about 42 volume percent of the silicide-based composite, the niobium-based metallic phase constitutes about 25 volume percent of the silicide-based composite, and the silicon-modified Laves phase constitutes about 33 volume percent of the silicide-based composite.

* * * * *